252-146 AU 157 EX
9/17/85 XR 4,541,945

United States Patent [19]
Anderson et al.

[11] Patent Number: 4,541,945
[45] Date of Patent: Sep. 17, 1985

[54] INHIBITOR-CONTAINING ACID CLEANING COMPOSITIONS AND PROCESSES

[75] Inventors: James D. Anderson, Fort Washington; Sandra K. Seigle, Phoenixville, both of Pa.

[73] Assignee: Amchem Products, Ambler, Pa.

[21] Appl. No.: 534,353

[22] Filed: Sep. 23, 1983

Related U.S. Application Data

[63] Continuation-in-part of Ser. No. 431,857, Sep. 30, 1982, abandoned.

[51] Int. Cl.[4] ..... C11D 7/00; C23G 1/06
[52] U.S. Cl. ..... 252/149; 134/41; 252/86; 252/146; 252/148
[58] Field of Search ..... 134/41; 252/146, 148, 252/149, 86, 142

[56] References Cited

U.S. PATENT DOCUMENTS

| | | | |
|---|---|---|---|
| 2,758,970 | 8/1956 | Saukaitis et al. | 252/8.55 |
| 3,047,510 | 7/1962 | Cizek | 252/436 |
| 3,291,743 | 12/1966 | Bost et al. | 252/149 |
| 3,330,769 | 7/1967 | Golben et al. | 252/136 |
| 3,530,000 | 9/1970 | Searles et al. | 134/22 |
| 3,535,240 | 10/1970 | Lyness | 252/8.55 |
| 3,607,781 | 9/1971 | Kaneko et al. | 252/389 |
| 3,630,933 | 12/1971 | Dudlik et al. | 252/148 |
| 3,634,270 | 1/1972 | Engle et al. | 252/149 |
| 3,668,137 | 6/1972 | Gardner et al. | 252/149 |
| 3,676,354 | 7/1972 | Kaneko et al. | 252/147 |
| 3,992,313 | 11/1976 | Anderson et al. | 252/149 |
| 4,104,303 | 8/1978 | Anderson et al. | 260/570 |
| 4,174,290 | 11/1979 | Leveskis | 252/142' |

FOREIGN PATENT DOCUMENTS 889571 2/1962 United Kingdom .

OTHER PUBLICATIONS

European Search Report #EP 83305967.

*Primary Examiner*—Prince E. Willis
*Attorney, Agent, or Firm*—Ernest G. Szoke; Henry E. Millson, Jr.; Mark A. Greenfield

[57] ABSTRACT

Acid cleaning compositions containing an inhibitor for cleaning metal surfaces, processes for cleaning metal surfaces therewith, and concentrates useful in forming the acid cleaning compositions. The present acid cleaning compositions contain an acid, a Mannich base, a thiourea, an alkyl trimethyl ammonium halide and/or an alkyl ($C_8$-$C_9$) phenoxypolyethoxy ethanol, and a nonionic surfactant which is a condensate of poly(oxyethylene) and poly(oxypropylene) groups.

26 Claims, No Drawings

INHIBITOR-CONTAINING ACID CLEANING COMPOSITIONS AND PROCESSES

This application is a continuation-in-part of U.S. patent application Ser. No. 431,857, filed Sept. 30, 1982, now abandoned.

BACKGROUND OF THE INVENTION

The use of industrial processing equipment, particularly equipment used for aqueous processes, generally results in the buildup of water insoluble deposits, especially at elevated temperatures. These deposits require periodic removal from the inner surfaces of tanks, conduits and the like without disassembling the components thereof. Acid solutions have been used successfully to remove these deposits, e.g. mill scale and fly ash, in industries such as chemical and petroleum plants, paper mills, utility companies and the like.

In the cleaning of such metal surfaces using aqueous solutions of acids wherein the cleaning of the metal surfaces includes the removal of acid soluble, water-insoluble deposits thereon, such as mmetal oxide scale, an inhibitor is often used in the cleaning solution to reduce acid attack on the metal surface. When the term "scale" is used hereinafter, it is understood to include other acid soluble, water-insoluble deposits as well as metal oxide scale. Both inorganic and organic acid baths are currently being used commercially for the removal of scale.

Among the acids generally used for industrial cleaning the inorganic acids, particularly, the mineral acids such as hydrochloric, sulfuric, nitric, and phosphoric acid are most frequently used, though others are also used depending upon the particular needs. In still other cases, organic acids including formic acid, citric acid, mixtures of hydroxy acetic and formic acids, and acetic acid and other organic acids, such as oxalic acid, tartaric acid and alkylene polyamine carboxylic acids as well as water soluble salts and mixes of acids and salts are used.

One of the mineral acids that has been used successfully in the removal of scale is hydrofluoric acid. Compositions of hydrofluoric acid containing an inhibitor are disclosed in U.S. Pat. No. 3,992,313 and No. 4,104,303 to Anderson et al. The compositions disclosed in the Anderson patents are disclosed for use with ferrous metals and with hydrofluoric acid as the acid cleaning agent. The Anderson compositions contain an inhibitor which comprises a Mannich base and thiourea.

Inhibitors when stored and shipped for end use in forming the acid cleaning baths, may gel and/or solidify at low storage and shipping temperatures and the components thereof may separate or precipitate on warming. When concentrates of inhibitors with organic acids were formed, such concentrates also exhibited precipitation problems due to inherently low solubility and/or stability of the inhibitors in the concentrates.

In the field of acid cleaning of scale from metal surfaces there is needed a bath composition that will clean metals in addition to those that are ferrous based and in which the bath will operate regardless of the acid chosen i.e. will be operable in either a bath based on an inorganic acid or on an organic acid. In addition, in order to be commercially feasible, the bath must also inhibit acid attack on the metal surfaces. A further need in this field is for a concentrated composition which contains the inhibitor plus surfactant which can be added to an acid cleaning bath and which is stable in the concentrated form. An additional need is for the concentrated composition that contains all of the ingredients required to form an organic acid-based cleaning bath upon dilution thereof with water, and which will be stable in the concentrated form.

DETAILED DESCRIPTION OF THE INVENTION

The present invention relates to acid cleaning baths that are useful for cleaning a variety of metal surfaces and will effectively remove scale therefrom; which can be formulated with a variety of inorganic and organic acids; which will inhibit the acid attack on the metal surfaces treated; and which in addition can form stable concentrates.

The inhibited acid cleaning baths of the invention have the following composition:

1. From about 5 to about 200 g/l, preferably from about 10 to about 100 g/l of a metal cleaning acid or a mixture of two or more of such acids;
2. From about 0.01 to about 9.5 g/l, preferably from about 0.05 to about 2.0 g/l, of a Mannich base or mixture of two or more Mannich bases;
3. From about 0.006 to about 5.8 g/l, preferably from about 0.03 to about 1.2 g/l, of either thiourea, a substituted thiourea, or a mixture of such thioureas;
4. From about 0.008 to about 7.5 g/l, preferably from about 0.03 to about 1.5 g/l, of a surfactant which is a condensate of poly(oxyethylene) and poly (oxypropylene) groups; and
5. At least one surfactant which is an alkyl trimethyl ammonium halide and/or an alkyl ($C_8$–$C_9$)-phenoxypolyethoxy ethanol; said alkyl trimethyl ammonium halide being present in an amount from about 0.004 to about 4.1 g/l, preferably from about 0.02 to about 0.8 g/l, and the ethanol derivative being present in an amount from about 0.002 to about 0.8 g/l, preferably from about 0.01 to about 0.5 g/l, with the proviso that when the metal cleaning acid is other than glycolic acid, formic acid or a mixture of glycolic acid and formic acid, an alkyl trimethylammonium halide must be present as the surfactant.

Optionally, other ingredients can also be present in the instant baths, including for example, 6. From about 0.007 to about 7.3 g/l, preferably from about 0.03 to about 1.4 g/l, of a lower alkanol.

The acid or mixture of acids that can be employed in the acid cleaning baths of the invention as component 1. above, include the following, used either alone or in mixtures of two or more: hydrofluoric acid, a mixture of hydrofluoric acid and ammonium bifluoride, sulfuric acid, sulfamic acid, hydrochloric acid, phosphoric acid; and organic acids such as formic acid, acetic acid, citric acid, propionic acid, glycolic acid, a mixture of glycolic acid and formic acid, ethylenediaminetetraacetic acid, and the like. These acids can also be buffered as desired, using known buffering agents. Typical concentrations of acids employed in such acid cleaning baths are for example, 10–50 g/l of HF, 50 g/l of acetic acid, 60 g/l of citric acid, 50–100 g/l of hydrochloric acid, etc.

The Mannich base or mixture of Mannich bases that can be employed in the acid cleaning baths of the invention as component 2. above are prepared by reactions of the Mannich type comprising a condensation reaction product of a primary or secondary amine, an alpha ketone, and formaldehyde. In preparing the Mannich base, a nitrogen compound having at least one active hydrogen attached to a nitrogen atom, for example, a primary amine or a secondary amine is reacted with an alpha ketone and formaldehyde in the presence of an acid. Exemplary of the ketone reactant is acetone, methylethyl ketone, isobutylmethyl ketone, diacetone alcohol, 2,4-pentanedione, acetonylacetone, phorone, mesityl oxide, cyclopentanone, propiophenone, acetonaphthone, acetophenone, p-methoxyacetophenone, p-chloroacetophenone, 2-heptanone, 2-undecanone, 2-acetylcyclohexanone, butyrophenone, naphthalenone, cyclohexanone, and tetrolophenone.

The class of Mannich bases disclosed in U.S. Pat. No. 3,668,137 can be used herein and is incorporated by reference in the present application. A preferred class of Mannich bases for use herein are the rosin amine Mannich bases, e.g. abietylamine, hydroabietylamine, and/or dehydroabietylamine. This class of compounds and their preparation are disclosed in U.S. Pat. No. 2,758,970 the disclosure of which is incorporated herein by reference.

The thiourea or substituted thiourea (component 3. above) that is used in the cleaning baths of the invention can be thiourea itself, used alone or in combination with a substituted thiourea, a substituted thiourea, or a mixture of two or more substituted thioureas. The substituted thioureas that can be used herein are monoalkyl, dialkyl, trialkyl, or tetraalkyl substituted thioureas or monoaryl or diaryl substituted thioureas or a cyclic thiourea with a $C_2$–$C_5$ alkylene group, e.g. tetramethyl thiourea, trimethyl thiourea, 1-phenyl-2-thiourea, 1,3-dimethyl thiourea, diisopropyl thiourea, 1,3-diethyl thiourea, 1,3-dibutyl thiourea, mono-orthotolyl thiourea, 1,3-diphenyl thiourea, 1,3-diorthotolyl thiourea, ethylene thiourea, trimethylene thiourea, monoallyl thiourea, etc. It should be noted that while monoaryl or diaryl thioureas can be used in the practice of the invention, they tend to be less soluble than the alkyl thioureas and are therefore less desirable.

The surfactants that can be used in the present compositions as component 4. above are condensates of poly(oxyethylene) and poly(oxypropylene) groups. A common source of surfactants of this type are the PLURONIC F, PLURONIC L, and PLURONIC P series marketed by BASF-Wyandotte Industrial Chemicals Group. Preferred compounds are PLURONIC P-65 and PLURONIC P-85 with PLURONIC P-65 most preferred. PLURONIC P-65 has a molecular weight of about 3500, and has approximately equal quantities of poly(oxyethylene) and poly(oxypropylene) groups.

The alkyl trimethyl ammonium halides (component 5. above) which can be used herein are compounds sold under the trade name ARQUAD, marketed by Armak Industrial Chemicals Division, Akzona, Inc. The alkyl group in these compounds is a long chain hydrocarbon group derived from a fatty acid, usually a $C_8$ to $C_{18}$ hydrocarbon chain, which can be either saturated or mono- or diolefinically unsaturated. The ARQUADS are usually mixtures of two or more of such compounds. A particularly useful product of this type for use herein is ARQUAD 18–50% which is a mixture of 3% hexadecyl trimethyl ammonium chloride, 46.5% octadecyl trimethyl ammonium chloride, and 0.5% octadecenyl trimethyl ammonium chloride, with the remainder isopropanol. While the ARQUADS are sold as the chloride salts, the bromide or iodide salts could equally well be used in the practice of this invention.

The nonionic surfactants of the class of alkyl ($C_8$–$C_9$) phenoxypolyethoxy ethanols preferably contain from 5 to 15 moles, more preferably 8 moles, of ethylene oxide per mole of alkyl ($C_8$–$C_9$) phenol. Such surfactants preferably have an HLB (hydrophilic lipophilic balance) of from about 12.8 to about 17.3. Suitable nonionic surfactants include IGEPAL CO-850 (nonylphenoxy-polyethoxy-ethanol) having an HLB of about 16.0 (GAF Co.); MAKON-8 (a mixture of alkylphenoxy polyethoxy-ethanols) (Stepan Chemical Co.); TRITON X-102 (octyl-phenoxy-polyethoxy-ethanol) having an HLB of about 14.6 (Rohm & Haas Co.); SURFONIC N-150 (nonyl-phenoxy-polyethoxy-ethanol) having an HLB of about 15.0 (Texaco Chemical Co.) and the like.

The lower alkanol (optional component 6. above) can be a straight or branched chain $C_1$ to $C_6$ alkanol, preferably isopropyl alcohol.

The cleaning solutions of the invention can be used to treat a number of metal surfaces, including ferrous based metals such as cold rolled steel, stainless steel, etc., as well as other metals that are not ferrous based, such as aluminum, copper, nickel, and alloys of the foregoing. Cleaning of the metal surface to remove scale is preferably carried out at a temperature in the range of from about 10° C. to about 100° C., preferably about 65° C. to about 90° C. Any method of bringing the cleaning solution in contact with the metal surface can be employed; for example, by immersing the metal object in a bath containing the cleaning solution or by spraying the cleaning solution onto the metal object or, in the case of metal industrial equipment, such as metal pipes and conduits, vessels, etc., having the cleaning solution inside the equipment or flowing through the pipe or conduit.

The novel inhibited acid cleaning solutions of the invention can be formed using concentrates containing cleaning solution components, or the cleaning solution components can be added separately to the required quantity of water to form the cleaning solution. Normally, however, for practical commercial purposes the concentrates of the invention are employed to form the novel cleaning solutions. The concentrates described below in terms of parts by weight of the components of the concentrates can vary widely in terms of absolute concentrations. Usually, concentrates are desired that have the ingredients thereof present in high enough concentration to result in containers of convenient size for use in making up or replenishing the cleaning solution, while still maintaining a solution of the ingredients under usual storage and shipping conditions.

One type of concentrate that can be used in the practice of the invention is a concentrate which can be added to an aqueous solution in which the acid cleaning component is already present or is to be added separately, or which can be added to acid concentrates of organic acids that are used to form the acid component of the cleaning solutions of the invention when such acid concentrates are diluted with a controlled quantity of water. Concentrates of this type, referred to herein for convenience as "Concentrate A", have the following ingredients in the following parts by weight relationship.

Concentrate A

Components:

A. From about 0.006 to about 5.8 parts, preferably from about 0.03 to about 1.2 parts, of thiourea and/or substituted thiourea;

B. From about 0.01 to about 9.5 parts, preferably from about 0.05 to about 2.0 parts of Mannich base;

C. From about 0.008 to about 7.5 parts, preferably from about 0.03 to about 1.5 parts of surfactant which is a condensate of poly(oxyethylene) and poly (oxypropylene) groups; and D. From about 0.004 to about 4.1 parts, preferably from about 0.02 to about 0.8 parts of alkyl trimethyl ammonium halide and/or from about 0.002 to about 0.8 parts, preferably from about 0.01 to about 0.5 parts of an alkyl($C_8$–$C_9$) phenoxypolyethoxy ethanol, except that when the metal cleaning acid to be used is other than glycolic acid, formic acid or a mixture thereof, an alkyl trimethyl ammonium halide must be present in the concentrate.

Optional Component:

E. From about 0.007 to about 7.3 parts, preferably from about 0.03 to about 1.4 parts of a lower alkanol; and with concentrates of the A type, the thiourea and/or substituted thiourea is preferably present in quantities greater than about 100 g/l, and usually greater than about 150 g/l.

When the above concentrate is mixed with concentrated organic acids, the resulting concentrate ("Concentrate B"), which contains all of the ingredients needed to form the novel organic acid cleaning baths of the invention, comprise the following:

Concentrate B

Components:

A. From about 0.006 to about 5.8 parts, preferably from about 0.03 to about 1.2 parts, of thiourea and/or substituted thiourea;

B. From about 0.01 to about 9.5 parts, preferably from about 0.05 to about 2.0 parts of Mannich base;

C. From about 0.008 to about 7.5 parts, preferably from about 0.03 to about 1.5 parts of a surfactant which is a condensate of poly(oxyethylene) and poly(oxypropylene) groups;

D. From about 0.004 to about 4.1 parts, preferably from about 0.02 to about 0.8 parts of alkyl trimethyl ammonium halide and/or from about 0.002 to about 0.8 parts, preferably from about 0.01 to about 0.5 parts of an alkyl ($C_8$–$C_9$) phenoxypolyethoxy ethanol, except that when component E. below is other than glycolic acid, formic acid, or a mixture thereof, an alkyl trimethyl ammonium halide must be present in the concentrate.

E. From about 5 to about 200 parts, preferably from about 10 to about 100 parts of an organic acid or a mixture of 2 or more organic acids.

Optional Components:

F. From about 0.007 to about 7.3 parts, preferably from about 0.03 to about 1.4 parts of a lower alkanol.

The following examples are given for illustration purposes only and are not meant to limit the invention.

EXAMPLE 1

A concentrate was prepared as follows:

I. Preparation of the Mannich base 280.3 g of dehydroabietylamine was placed in a closed reaction kettle equipped with a reflux condensor, and 93.5 g of acetophenone (tech. grade) was added thereto. Then 111.1 g of 70% hydroxyacetic acid was added slowly with stirring. The resulting mixture was then stirred until all ingredients were in solution. Then 116.0 g of 37% formaldehyde solution was added slowly over a period of 2 hours. The resulting mixture was stirred and heated to 90° C. for 24 hours. The contents of the kettle were cooled to 50° C. and 299.5 g of acetone added. The mixture was stirred until solution was complete, and 114.1 g of 37% formaldehyde added over a period of 1 hour. The reaction mixture was then refluxed for 24 hours at a temperature of 70° C. Excess acetone was distilled off and the temperature increased to 90° C. while distillate was removed. The contents of the kettle were then cooled to 50° C. and 168.5 g of SURFONIC N-150 added, together with 10.4 g of water. The resulting mixture was stirred, cooled to 40° C., and 104.2 g of 91% isopropyl alcohol added. Stirring was continued for one hour at 40° C.

II. Preparation of the concentrate

A concentrated composition was prepared by dissolving the following ingredients in water at the concentration levels specified:

| | |
|---|---|
| Mannich base product mixture prepared in I. above | 530 g/l |
| PLURONIC P-65 | 267 g/l |
| Thiourea | 207 g/l |
| Isopropyl alcohol (91%) | 60 g/l |
| Hydroxyacetic acid (70%) | 43 g/l |

The above concentrated composition was clear and homogeneous at both room temperature and at 5° F. In addition, when the concentrated composition was warmed from 5° F. to room temperature, no separation of components occurred.

When PLURONIC P-85 was substituted for PLURONIC P-65 in the above concentrated composition, the resulting concentrated composition was clear and homogeneous at room temperature, was frozen solid at 5° F., and when warmed from 5° F. to room temperature, a slight phase separation occurred.

In the above concentrated compositions, the isopropanol and the hydroxyacetic acid were added to enhance solubility.

A concentrate (CONCENTRATE A) was prepared from the following ingredients:

| CONCENTRATE A | |
|---|---|
| Concentrated composition prepared above containing PLURONIC P-65 | 59.28% by weight |
| ARQUAD 18-50% | 15.70% by weight |
| Tap water | 25.02% by weight |

EXAMPLE 2

A concentrate (CONCENTRATE B-1) was prepared from the following ingredients:

| CONCENTRATE B-1 | |
|---|---|
| CONCENTRATE A | 1 part by volume |
| Acid concentrate consisting of 71.4% by volume of 70 glycolic acid and 28.6% by volume of 90% formic acid. | 30 parts by volume |

EXAMPLE 3

A concentrate (CONCENTRATE B-2) was prepared from the following ingredients:

| CONCENTRATE B-2 | |
|---|---|
| CONCENTRATE A | 1 part by volume |
| Acid concentrate of | 30 parts by volume |

-continued

| CONCENTRATE B-2 |
|---|
| 45% by weight EDTA in water (pH adjusted) to 5.5 with $NH_4OH$) |

EXAMPLE 4

A concentrate (CONCENTRATE B-3) was prepared from the following ingredients:

| CONCENTRATE B-3 | |
|---|---|
| CONCENTRATE A | 1 part by volume |
| Acid concentrate of 50% by weight of citric acid in water (adjusted to pH 3.5 with $NH_4OH$) | 30 parts by volume |

EXAMPLE 5

An acid metal cleaning solution was prepared by adding 3.1% by volume of CONCENTRATE B-1 (prepared in EXAMPLE 2) to water. The resulting cleaning solution was heated to 190° F. Six metal coupons of clean cold rolled steel (1010 CRS), each coupon having a total surface area of about 7 square inches, were immersed in the above cleaning solution for 6 hours. The weight loss for each metal coupon is given below:

| Metal coupon | Weight loss, grams |
|---|---|
| 1 | 0.0089 |
| 2 | 0.0088 |
| 3 | 0.0072 |
| 4 | 0.0071 |
| 5 | 0.0136 |
| 6 | 0.0114 |

This example shows that the cleaning solutions of the invention, containing quantities of acids which are known to be effective for cleaning scale from ferrous metals, exhibit very substantial metal protecting properties.

EXAMPLE 6

The cleaning solution of EXAMPLE 5 is maintained at 190° F. and a coupon of cold rolled steel (1010 CRS) having a total surface area of 7 square inches which is coated with an average of 2 mm. of mill scale from a paper mill is immersed in the cleaning solution for a period of 24 hours. At the end of this period, the coupon is removed, rinsed, and examined. All surfaces of the coupon are clean and completely free of mill scale.

When the above cleaning solution is used to treat the following metal coupons (7 square inch surface area) coated with an average of 2 mm mill scale from a paper mill by immersion therein for 24 hours at 190° F., all coupons are clean and free of mill scale: aluminum; copper; brass; galvanized steel; and nickel plated steel.

EXAMPLE 7

An acid metal cleaning solution was prepared by adding to water (a) 3% by volume of an acid concentrate (CONCENTRATE C) consisting of 71.4% by volume of 70% glycolic acid and 28.6% by volume of 90% formic acid, and (b) 0.1% by volume of a concentrate having the following composition:

| Component | % by weight |
|---|---|
| Mannich base product mixture prepared in EXAMPLE 1 (I) | 28.78 |
| PLURONIC P-65 | 14.53 |
| 1,3-dimethylthiourea | 11.24 |
| ARQUAD 18-50 | 15.94 |
| Isopropyl alcohol, 91% | 3.27 |
| Hydroxyacetic acid, 70% | 2.34 |
| Water | 23.90 |

The cleaning solution was heated to 190° F. and two metal coupons of clean cold rolled steel (1010 CRS), each coupon having a total surface area of about 7 square inches, were immersed in the hot cleaning solution for 6 hours. The coupons were then removed, rinsed in water, and dried. The weight loss of the metal coupons is given below:

| Metal coupon | Weight loss, grams |
|---|---|
| 1 | 0.0063 |
| 2 | 0.0068 |

EXAMPLE 8

An acid metal cleaning solution was prepared by adding to water 2.3% by volume of 70% HF and 0.1% by volume of CONCENTRATE A prepared in EXAMPLE 1 above.

Seven clean metal coupons (about 7 square inch surface area) of the compositions given below were immersed in the above cleaning solution for 6 hours at 150° F. The metal coupons were then removed, rinsed with water and dried. The weight loss of each coupon is given below:

| Composition of Metal Coupons | Weight loss/grams |
|---|---|
| Cast iron | 0.0156 |
| Admiralty brass | 0.0053 |
| 304 SS(1) | 0.0053 |
| 316 SS(1) | 0.0080 |
| 410 SS(1) | 0.0063 |
| CRS(2) | 0.0046 |
| Copper | 0.0057 |

(1)Stainless steel
(2)1010 cold rolled steel.

EXAMPLE 9

Concentrates were prepared having the following compositions:

| CONCENTRATE D | |
|---|---|
| Component | g/l |
| Mannich base product mixture prepared in EXAMPLE 1 (I) | 296 |
| PLURONIC P-65 | 150 |
| Tetramethylthiourea | 116 |
| ARQUAD 18-50 | 164 |
| Isopropyl alcohol, 91% | 34 |
| Hydroxyacetic acid, 70% | 24 |
| Tap water | 246 |

Six concentrates were prepared containing the concentrated acids given below. These concentrates were stored at room temperature for one week and then examined visually. The appearance of each concentrate is also given below.

| Concentrate | Composition | Appearance after 1 week |
|---|---|---|
| CONCENTRATE E | 1 ml of CONCENTRATE D per 30 ml of glycolic acid/formic acid(1) | slightly cloudy |
| CONCENTRATE F | 5 ml of CONCENTRATE D per 30 ml of glycolic acid/formic acid(1) | slightly cloudy |
| CONCENTRATE G | 1 ml of CONCENTRATE D per 30 ml of 90% formic acid | clear to slightly cloudy |

EXAMPLE 10

CONCENTRATE H

A concentrate was prepared having the following composition in parts by weight:

| Component | Parts by Weight |
|---|---|
| Mannich base product mixture prepared in EXAMPLE 1 (I) | 296.2 |
| PLURONIC P-65 | 149.5 |
| 70% Glycolic Acid | 24.10 |
| 1,3-Dimethyl-thiourea | 115.7 |
| Isopropyl Alcohol 91% | 33.7 |
| ARQUAD 18-50 | 164.0 |
| Tap Water | 246.0 |

EXAMPLE 11

CONCENTRATE I

A concentrate was prepared having the following composition in parts by weight:

| Component | Parts by Weight |
|---|---|
| Mannich base product mixture prepared in EXAMPLE 1 (I) | 295.25 |
| PLURONIC P-65 | 151.96 |
| 70% Glycolic Acid | 23.65 |
| 1,3-Dimethyl-thiourea | 116.05 |
| Isopropanol 91% | 33.90 |
| MAKON 8 | 159.03 |
| Tap Water | 276.14 |

CONCENTRATE J

Concentrate J was prepared having the same composition as Concentrate I except that 159.03 parts by weight of TRITON X-102 were used in place of the 159.03 parts by weight of MAKON 8.

CONCENTRATE K

Concentrate K was prepared having the same composition as concentrate I except that 159.03 parts by weight of IGEPAL CO-850 were used in place of the 159.03 parts by weight of MAKON 8.

5 ml from each of the inhibitor concentrates H, I, J and K were added to 20 ml of a solution containing 71.4% by volume of glycolic acid-70% and 28.6% by volume of formic acid. The resultant compositions were stored at room temperature for one week and then examined visually. Each composition remained clear and stable.

Tests were also run with each of the inhibitor concentrates to see if the freezing point or the freez-thaw stability had been affected. The freezing point remained below 0° F., and complete homogeneity returned to each concentrate.

What is claimed is:

1. An aqueous acidic cleaning solution for cleaning acid soluble, water-insoluble deposits from metal surfaces comprising:

(a) from about 5 to about 200 g/l of at least one metal cleaning acid;

(b) from about 0.01 to about 9.5 g/l of at least one Mannich base;

(c) from about 0.006 to about 5.8 g/l of at least one thiourea compound;

(d) from about 0.008 to about 7.5 g/l of at least one surfactant which is a condensate of poly(oxyethylene) and poly(oxypropylene) groups; and (e) at least one of a surfactant selected from the group consisting of alkyl trimethyl ammonium halides and alkyl ($C_8$–$C_9$) phenoxypolyethoxy ethanols, said alkyl trimethyl ammonium halides being present in an amount from about 0.004 to about 4.1 g/l and said alkyl ($C_8$–$C_9$) phenoxypolyethoxy ethanols being present in an amount from about 0.002 to about 0.8 g/l, with the proviso that when the metal cleaning acid is other than glycolic acid, formic acid or a mixture of glycolic acid and formic acid, an alkyl trimethyl ammonium halide must be present.

2. An aqueous acidic cleaning solution in accordance with claim 1 wherein there is also present from about 0.007 to about 7.3 g/l of a lower alkanol.

3. An aqueous acidic cleaning solution in accordance with claim 1 wherein the surfactant in (e) is an alkyltrimethyl ammonium halide.

4. An aqueous acidic cleaning solution in accordance with claim 3 wherein the quantities of components present are as follows:

(a) from about 10 to about 100 g/l (b) from about 0.05 to about 2.0 g/l (c) from about 0.03 to about 1.2 g/l (d) from about 0.03 to about 1.5 g/l and (e) from about 0.02 to about 0.8 g/l.

5. An aqueous acidic cleaning solution in accordance with claim 4 wherein at least one of the following are also present:

(f) from about 0.01 to about 0.5 g/l of an alkyl ($C_8$–$C_9$) phenoxypolyethoxy ethanol surfactant; and (g) from about 0.03 to about 1.4 g/l of a lower alkanol.

6. An aqueous cleaning solution in accordance with claim 1 wherein the surfactant in (e) is an alkyl ($C_8$–$C_9$) phenoxypolyethoxy ethanol.

7. An aqueous cleaning solution in accordance with claim 6 wherein the quantities of the components present are as follows:

(a) from about 10 to about 100 g/l;

(b) from about 0.05 to about 2.0 g/l;

(c) from about 0.03 to about 1.2 g/l;

(d) from about 0.3 to about 1.5 g/l; and (e) from about 0.01 to about 0.5 g/l.

8. An aqueous cleaning solution in accordance with claim 7 which contains from about 0.03 to about 1.4 g/l of a lower alkanol.

9. An aqueous acidic cleaning solution in accordance with claim 1 wherein the acid is a mixture of formic and hydroxyacetic acids.

10. An aqueous acidic cleaning solution in accordance with claim 1 wherein the acid is hydrofluoric acid.

11. An aqueous acidic cleaning solution in accordance with claim 1 wherein the acid is ammoniated ethylenediamine tetraacetic acid.

12. An aqueous acidic cleaning solution in accordance with claim 1 wherein the acid is ammoniated citric acid.

13. An aqueous acidic cleaning solution in accordance with claim 1 wherein in (e) the alkyl group in the alkyl trimethyl ammonium halide is a linear $C_8$–$C_{18}$ alkyl group which is either saturated or olefinically unsaturated.

14. An aqueous acidic cleaning solution in accordance with claim 1 wherein the thiourea compound is an alkyl substituted thiourea.

15. An acidic cleaning solution in accordance with claim 1 wherein the Mannich base in (b) is the reaction product of a rosin amine, formaldehyde, acetophenone, and acetone prepared in the presence of a strong acid.

16. An acidic cleaning solution in accordance with claim 14 wherein the rosin amine used to form the Mannich base is dehydroabietylamine.

17. A concentrated composition useful as an additive to form an aqueous acid metal cleaning bath comprising:

(a) from about 0.006 to about 5.8 parts by weight of at least one thiourea compound;
(b) from about 0.01 to about 9.5 parts by weight of at least one Mannich base;
(c) from about 0.008 to about 7.5 parts by weight of at least one surfactant which is a condensate of poly(oxyethylene) and poly(oxypropylene) groups; and
(d) from about 0.004 to about 4.1 parts by weight of
(d) from about 0.004 to about 4.1 parts by weight of at least one alkyl trimethyl ammonium halide and/or from about 0.002 to about 0.8 parts by weight of an alkyl ($C_8$–$C_9$) phenoxypolyethoxy ethanol; and wherein the thiourea compound is present in at least about 100 g/l.

18. A concentrated composition in accordance with claim 17 wherein from about 0.007 to about 7.3 parts by weight of a lower alkanol is also present.

19. A concentrated composition in accordance with claim 17 wherein the quantities of components present are as follows:

(a) from about 0.03 to about 1.2 parts;
(b) from about 0.05 to about 2.0 parts;
(c) from about 0.03 to about 1.5 parts; and
(d) from about 0.02 to about 0.8 parts of alkyl trimethyl ammonium halide and/or from about 0.01 to about 0.5 parts of an alkyl ($C_8$–$C_9$) -phenoxypolyethoxy ethanol.

20. A concentrated composition in accordance with claim 17 wherein from about 5 to 200 parts by weight of at least one metal cleaning acid is also present, provided that when the acid is other than glycolic acid, formic acid, or a mixture thereof, an alkyl trimethyl ammonium halide is present in the concentrate.

21. A concentrated composition in accordance with claim 20 wherein from about 10 to about 100 parts by weight of at least one metal cleaning acid is present.

22. A process for cleaning a metal surface containing acid soluble, water-insoluble deposits thereon comprising contacting said metal surface with an aqueous acid cleaning solution comprising:

(a) from about 5 to about 200 g/l of at least one metal cleaning acid;
(b) from about 0.01 to about 9.5 g/l of at least one Mannich base;
(c) from about 0.006 to about 5.8 g/l of at least one thiourea compound;
(d) from about 0.008 to about 7.5 g/l of at least one surfactant which is a condensate of poly(oxyethylene) and poly(oxypropylene) groups; and
(e) at least one of a surfactant selected from the group consisting of alkyl trimethyl ammonium halides and alkyl ($C_8$–$C_9$) phenoxypolyethoxy ethanols, said alkyl trimethyl ammonium halides being present in an amount from about 0.004 to about 4.1 g/l and said alkyl ($C_8$–$C_9$) phenoxypolyethoxy ethanols being present in an amount from about 0.002 to about 0.8 g/l, with the proviso that when the metal cleaning acid is other than glycolic acid, formic acid or a mixture of glycolic acid and formic acid, an alkyl trimethyl ammonium halide must be present.

23. A process in accordance with claim 22 wherein the aqueous acidic cleaning solution also contains (g) from about 0.007 to about 7.3 g/l of a lower alkanol.

24. A process in accordance with claim 22 wherein the aqueous acid cleaning solution contains from about 0.004 to about 4.1 g/l of at least one alkyl trimethyl ammonium halide.

25. A process in accordance with claim 22 wherein in the aqueous acidic cleaning solution the quantities of components present are as follows:

(a) from about 10 to about 100 g/l;
(b) from about 0.05 to about 2.0 g/l;
(c) from about 0.03 to about 1.2 g/l;
(d) from about 0.03 to about 1.5 g/l.

26. A process in accordance with claim 22 wherein from about 0.03 to about 1.4 g/l of a lower alkanol is also present.

* * * * *